United States Patent [19]

Stearns et al.

[11] 4,107,243

[45] Aug. 15, 1978

[54] PREPARATION OF THERMOPLASTIC POLYMER FIBRILLA AND FIBRIL

[75] Inventors: Richard S. Stearns, Malvern; Neil A. Frankel, Media, both of Pa.; Elmer J. Hollstein, Wilmington, Del.

[73] Assignee: Suntech, Inc., St. Davids, Pa.

[21] Appl. No.: 694,749

[22] Filed: Jun. 10, 1976

[51] Int. Cl.[2] ..... D01D 5/04

[52] U.S. Cl. ..... 264/13; 264/140; 162/157 R

[58] Field of Search ..... 162/157 R; 264/140, 264/14 R, 13

[56] References Cited

U.S. PATENT DOCUMENTS 4,010,229 3/1977 Pleaska et al. ..... 264/140

FOREIGN PATENT DOCUMENTS 2,364,853 7/1974 Fed. Rep. of Germany ..... 264/13
47-32,131 8/1972 Japan ..... 162/157 R
47-33,725 8/1972 Japan ..... 162/157 R

*Primary Examiner*—Jay H. Woo
*Attorney, Agent, or Firm*—J. Edward Hess; Donald R. Johnson; Anthony Potts, Jr.

[57] ABSTRACT

Process is disclosed for preparing solid thermoplastic polymer fibrilla or fibril having a length which makes either useful for mixing with cellulosic pulp. Process involves forming a two phase mixture of polymer and solvent wherein one phase is a polymer-rich phase and the other is a solvent-rich phase. Said mixture is discharged through a suitable nozzle in laminar flow.

6 Claims, 5 Drawing Figures

MEAN FIBRIL LENGTH
VERSUS
REYNOLDS NUMBER AND RATIO OF LENGTH
TO INTERNAL DIAMETER OF
DISCHARGE MEANS

A. BATCH METHOD

B. CONTINUOUS METHOD

Fig. II
GENERALIZED PHASE DIAGRAM
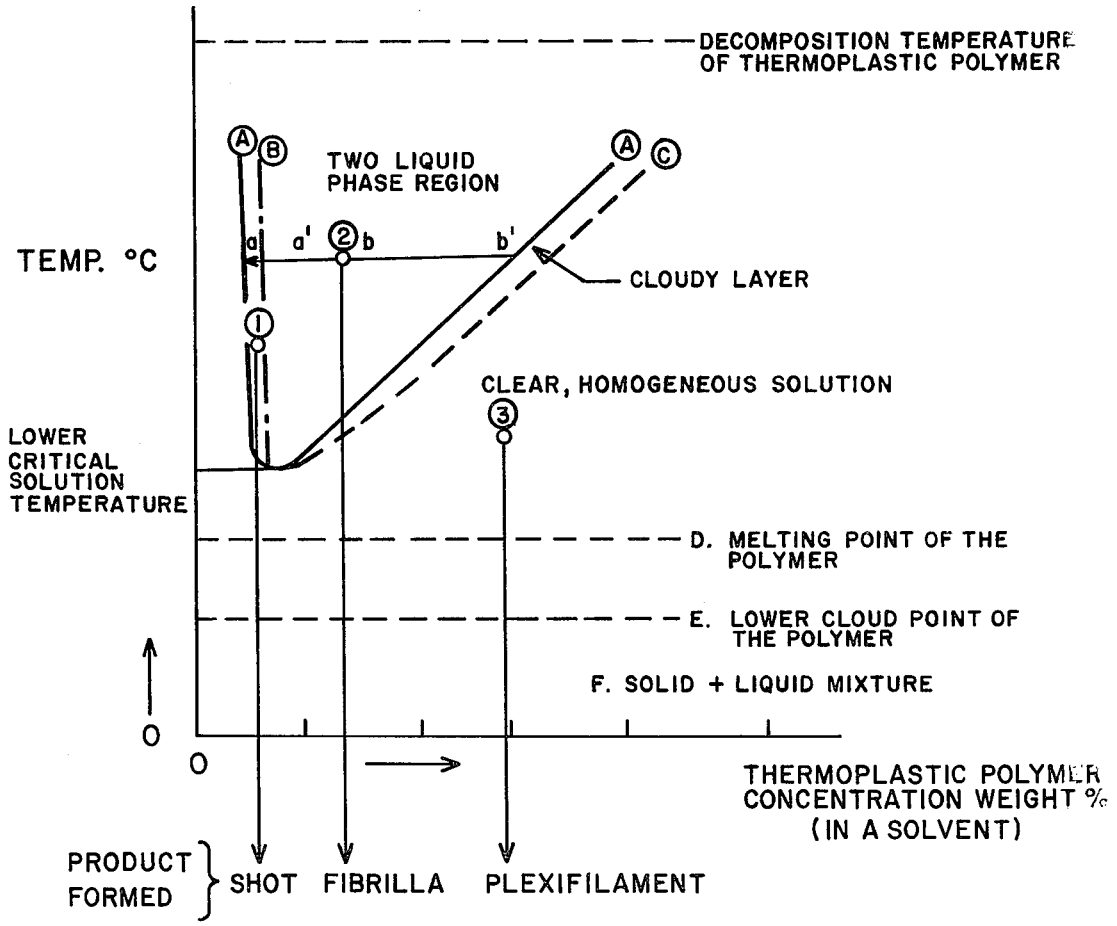

Fig. III
PHASE DIAGRAM FOR N-HEXANE-HIGH DENSITY POLYETHYLENE SYSTEM
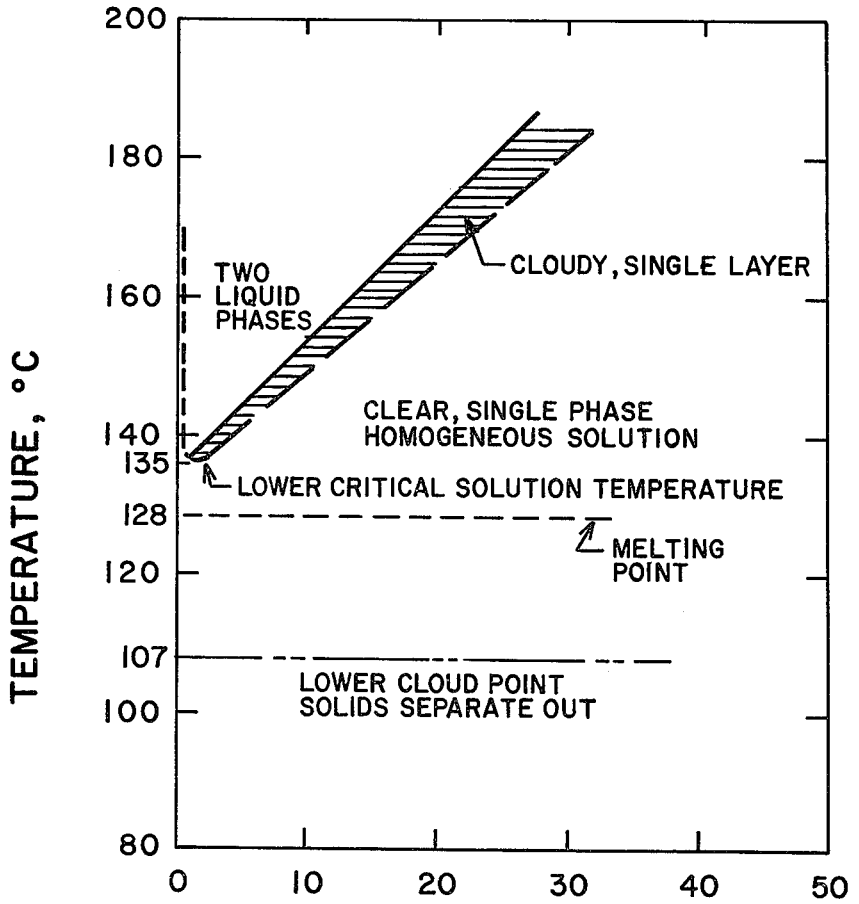

Fig. IV
MEAN FIBRIL LENGTH
VERSUS
REYNOLDS NUMBER AND RATIO OF LENGTH
TO INTERNAL DIAMETER OF
DISCHARGE MEANS
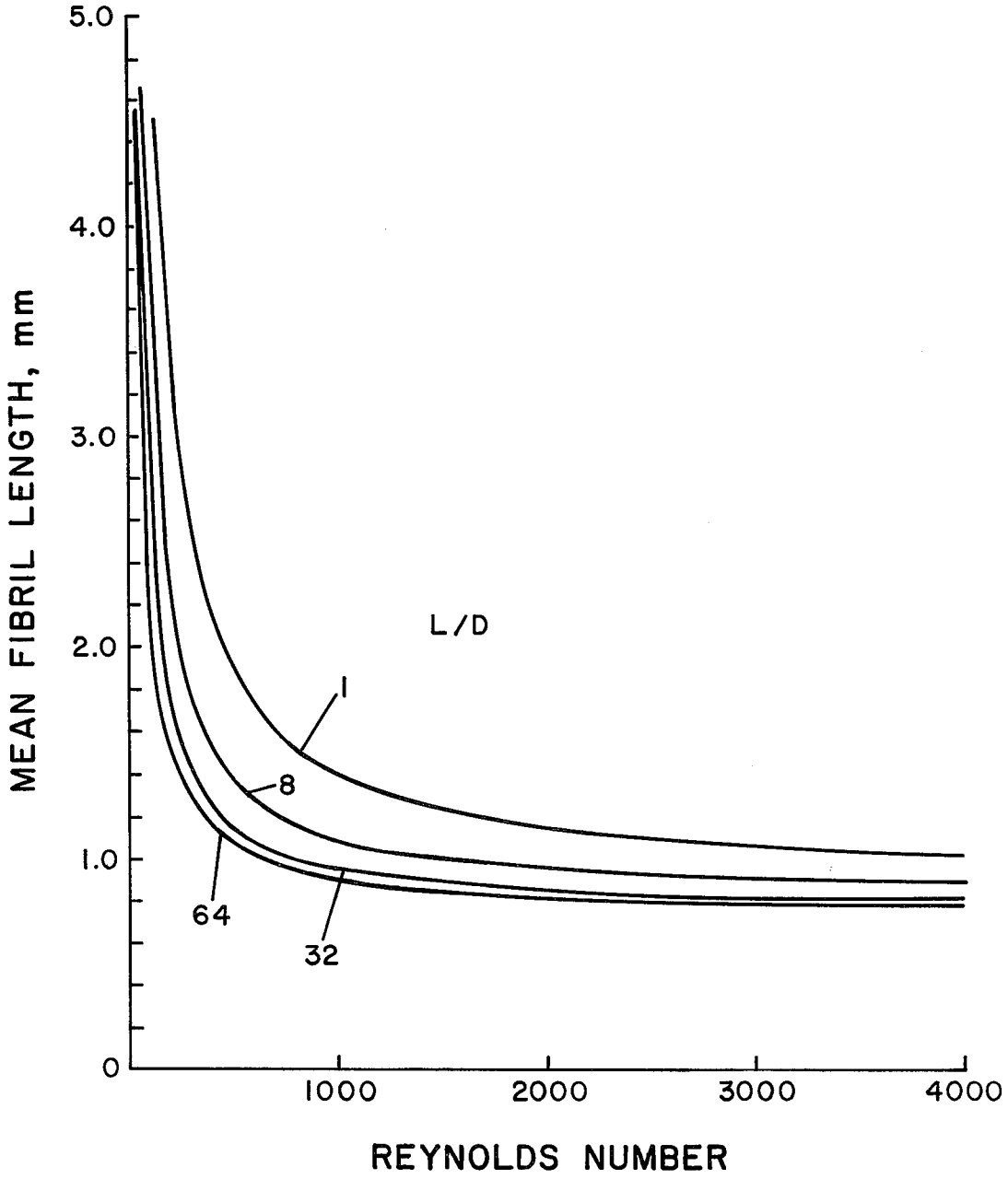

PREPARATION OF THERMOPLASTIC POLYMER FIBRILLA AND FIBRIL

BACKGROUND OF THE INVENTION

1. Field of the Invention

A new and useful process is disclosed. The process is directed to the making of thermoplastic polymer fibrilla or fibril. Both products are useful for mixing with cellulosic pulp thereby enhancing the properties of a resulting paper article. Also multicomponent thermoplastic polymer fibrilla and fibril are disclosed.

2. Background Art

U.S. Pat. No. 3,227,784, issued Jan. 4, 1966, discloses a process for direct production of ultramicrocellular structures and/or plexifilamentary products from a thermoplastic polymer solution. The solution is extruded through a suitable orifice or other equivalent means.

U.S. Pat. No. 3,081,519, issued Mar. 19, 1963, discloses a process for the production of integral, multifibrous, bulky strands directly from fluid polymer.

U.S. Pat. No. 3,032,384, issued May 1, 1962, discloses a process for production of thermoplastic polymer fibers from a relatively dilute solution of the polymer and a low boiling solvent. The process involves the use of a spinning orifice which causes the filaments that come through orifices to be spun together into a yarn.

U.S. Pat. No. 3,902,957, issued Sept. 2, 1975, discloses a process for the manufacturing of polymeric fibers involving the forming of a mixture of polymer and a solvent for such polymer and flashing said mixture. The flashing is at a temperature high enough to bring the polymer to a plastic state and permits substantially complete vaporization of the solvent when the mixture is flashed. Also, a processing step is disclosed in which the previously formed fibers are subjected to a light shredding action.

West German Patent publication 2458-390, publication date July 24, 1975, according to Central Patent Index by Derwent Publication Ltd., Index No. 51182W/31, discloses short fibril production from a two phase mixture composed of a melted polymer and solvent. The production involves passing the mixture, at high temperature and pressure, through an orifice. During the mixture's passage and expansion through the orifice it is subjected to turbulent flow and afterwards the solvent evaporates and the polymer solidifies.

Belgium Pat. No. 823-578, publication date June 19, 1975, (Derwent Index No. 44398W/27), discloses the production of short polyolefin fibers by dissolving the polyolefin in pentane, or a mixture containing pentane, under pressure, at a temperature above the boiling point of the pentane at atmospheric pressure. Then the solution is passed through an opening into a zone maintained at a lower pressure. The amount of the pentane present is such that the polyolefin separates in the form of discrete short fibers. Also, Belgium Pat. No. 823-440, (Derwent Index No. 4436W/27), publication date June 17, 1975, discloses a similar process and indicates other polymers can be used.

South African Patent 7400-893, publication date Nov. 11, 1974, Derwent Index No. 66237V/39, discloses the manufacture of discontinuous fibrils. The manufacture involves suddenly releasing the pressure acting on a two-phase mixture comprising molten polymer and solvent. The temperature and pressure of the mixture is such that when the pressure is released the solvent is instantaneously vaporized and the polymer solidified. The mixture is ejected at high speed through the orifice in such a way as to form an ejection cone which is atomised.

SUMMARY OF THE INVENTION

Method concerns a process for preparing thermoplastic polymer fibrilla or fibril having utility as an additive for cellulosic pulp.. The product has a mean length which makes it useful for mixing with cellulosic pulp. Resulting mixture is converted into useful articles such as wallpaper. The method involves discharging through discharge means a two-phase mixture of polymer and solvent, wherein one phase is a polymer-rich phase and the other is a solvent-rich phase. And the mixture flowing through the discharge means is in laminar flow. The latter can be determined by its Reynolds Number. Also another variable can be the ratio of length to internal diameter of the discharge means. Also multicomponent thermoplastic polymer fibrilla or fibril can be prepared by the foregoing method.

DESCRIPTION OF THE DRAWING

FIG. I is a schematic drawing of two processes to prepare thermoplastic polymer fibrilla.

FIG. IA discloses a batch method whereas FIG. IB discloses a continuous method.

Figure 1A:
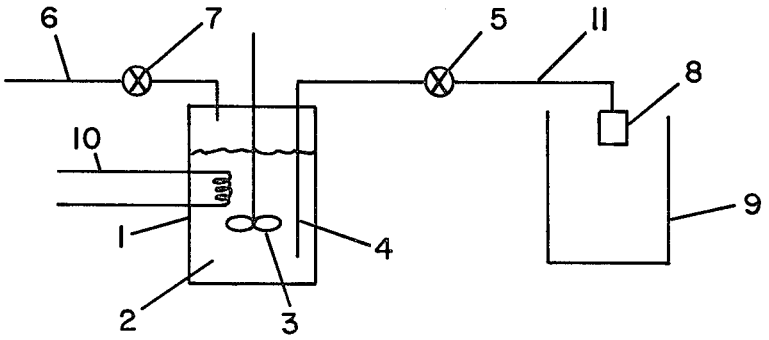
Figure 1B:
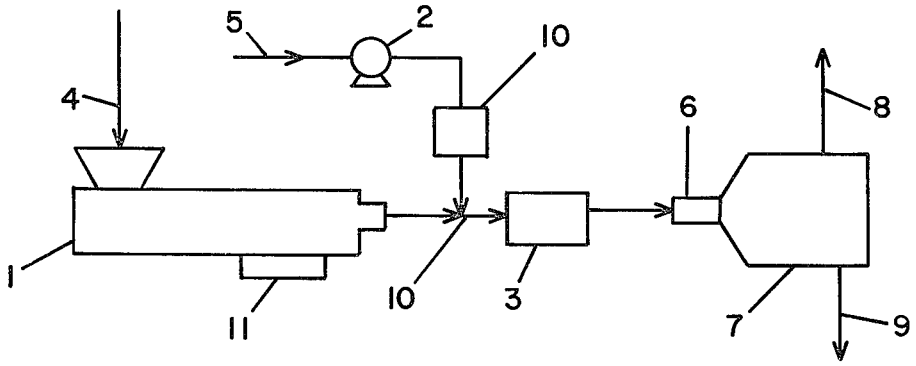

FIG. II is a generalized phase diagram relating to certain general conditions used to prepare the fibrilla.

FIG. III is a particular phase diagram for n-hexane and high density polyethylene system.

FIG. IV is a graph showing the relationship between the mean length of the fibril and the variables of Reynolds number and the ratio of length to internal diameter of the discharge means.

DESCRIPTION

The description that follows is divided into three sections. The first section describes the processes that can be used, e.g., batch and continuous, and equipment that can be associated with each. The second section relates general operating conditions, e.g., temperatures and concentrations, of the process with a general phase diagram as to the feed components, i.e., the thermoplastic polymer and the solvent. The third section relates the particlar operating conditions of the process as it relates a feed of n-hexane and high density polyethylene.

FIG. I is exemplary of processes that can be used to prepare thermoplastic polymer fibrilla. The schematic drawings of FIG. I are simplistic in that the drawings for example, do not show openings necessary to charge feed to a vessel, location of various instruments such as temperature measuring devices and/or pressure gauges, openings that may be necessary for cleaning and repairs, valves that facilitate repairs and maintenance and the like. Also not shown is any insulation and other heating or cooling device which may facilitate the making of the fibrilla. Furthermore the step used to convert the fibrilla into fibril is not shown.

A batch process can be best understood by reference to FIG. IA. A vessel 1 is filled with the desired amount of feed, i.e., thermoplastic polymer and solvent. Both are such that a desired concentration of polymer results. At ambient temperatures the two components of the feed are insoluble with each other so a mixture 2 results. Thus, the mixture 2 consists of a solid and a liquid. The mixture 2 is then heated to a proper temperature by an effective heating device 10. The proper temperature is defined generally in FIG. II and for a particular system in FIG. III. The aforementioned effective heating device 10 can be an electric heating coil; a heat exchanger or some other equally suitable apparatus. The mixture 2 is agitated by a mixing device such as a mixing blade 3. Other mechanisms are equally suitable. In FIG. IA the vessel is pressurized to an adequate pressure via line 6. An inert gas such as nitrogen can be used effectively. After adequate pressure is obtained line 6 is closed by valve 7. Adequate pressure is one which is at least sufficient to drive the feed through the apparatus. After the vessel is adequately pressurized and its contents are at the proper temperature, i.e., the feed is no longer a solid-liquid mixture but rather consists of two liquid phases, valve 5 is rapidly opened. Valve 5 controls the discharge of the the contents of the vessel 1 via dip tube 4 and connecting line 11. The two liquid-phase contents flow through the dip tube 4, pass valve 5, and into discharge means 8. Means 8 causes the contents entering it to be discharged to a zone which is at a lower pressure and temperature than vessel 1 just before its contents are released. Both operating conditions and discharge means 8 are such that the contents entering are discharged in a laminar flow. Examples of means 8 are a nozzle and an orifice; other suitable devices can be used. Because the pressure difference between the discharge zone and the vessel just prior to discharge can be substantial, the discharge through means 8 can be relatively rapid. Furthermore, the differences between the temperatures and pressures of the vessel 1 and the discharge zone are such that rapid evaporation of the solvent is favored after the contents leave means 8. The resulting formed fibrilla are collected in a suitable collecting device 9. In this example the collecting device 9 is open and the solvent escapes into the atmosphere.

A continuous process can be best understood by reference to FIG. IB. Solid thermoplastic polymer 4 is fed to an extruder 1, which in this example is also heated externally by heater 12. In the extruder 1 the polymer 4 is converted from a solid, usually pellets, to a molten polymer. The molten polymer is forced through the extruder by an internal screw (not shown). Pressure buildup within the extruder is determined by the ratio of the diamter of the screw to its length and other variables. By control of these variables adequate pressure can be obtained. Solvent 5 is pumped via pump 2 into a suitable heat exchanger 10 which regulates the temperature of the solvent so that it is at a desired temperature. Often the solvent will have to be heated. Upon leaving heat exchanger 10 the solvent 5 joins the molten polymer 4 at junction 11 and together both enter mixing means 3. Examples of suitable mixing means include jet mixer, orifice column, baffle-plate and others. After the molten polymer and the solvent are sufficiently mixed and are at a pressure and temperature whereby the mixture consists of two liquid phases, the two liquid-phase mixture enters discharge means 6. Discharge means 6 causes the mixture entering it to be discharged to a zone which is at a lower pressure and temperature than that which generally exists in the continuous apparatus. Said means 6 and other operating conditions are such that the contents entering it are discharged in a laminar flow. Examples of discharge means 6 are a nozzle and an orifice; other suitable devices can be used. Because the pressure difference between the discharge zone and the pressure existing in the continuous apparatus can be substantial the discharge through means 6 can be relatively rapid. Differences between the temperature and pressure of the continuous apparatus and the discharge zone are such that rapid evaporation of the solvent occurs after the contents leave means 6. The formed fibrilla are collected in a suitable collecting device 7. In this example the collecting device 7 is closed so that the solvent vapors 8 are collected, condensed and reused as solvent 5, if desired. Furthermore, in this example the essentially solvent-free fibrilla are removed from collecting device 7 continuously by suitable means (not shown), for example, movable conveyor belt. A closed collecting system as just described, except that the fibrilla is not removed continuously, could also be used with the previously discussed example of a batch method.

Another continuous process, not shown, is as follows. After a polymerization step in forming a thermoplastic polymer, e.g., ethylene to polyethylene, a polyethylene-rich hexane stream is often available. In other words, a stream is available which can be used directly thereby avoiding the extra handling steps that would be required using solid polymer. This stream can be, after any adjustments if necessary to achieve the desired temperature and pressure, fed directly to discharge means wherein laminar flow occurs. Thus, the resulting fibrilla are manufactured directly at the polymerization plant. If a closed collecting system is used the solvent, e.g., hexane, can be recycled to be used in the polymerization step itself.

The formed fibrilla are generally bundles of fibrils. These bundles can be further processed to reduce the number of the fibrils in the bundle or break up the bundle. The latter process is known as defibering. Also during defibering the fibrilla and resulting fibrils can also be reduced in length. These fibrils are also suitable for mixing with a cellulosic pulp. Fibrils can be prepared directly by the foregoing processes.

In the foregoing paragraphs, examples of continuous and batch methods of forming fibrilla are described in terms of the apparatus that can be used. In that description were references to the feed, i.e., thermoplastic polymer and solvent, and its physical condition, mainly at various temperatures. In order to understand this relationship more clearly, it is necessary to consider the general phase diagram shown in FIG. II.

FIG. II is a generalized phase diagram. It relates the concentration of a thermoplastic polymer in a suitable liquid and the physical condition of the two as temperature of the polymer and solvent changes.

FIG. II indicates that below the melting point of the polymer line D and its lower cloud point, line E, the polymer and a suitable liquid together form a hetergeneous mixture F. However, as the temperature increases till it is about the melting point of the polymer, line D, the heterogeneous mixture no longer exists and in its place is a clear homogeneous solution. As the temperature if further increased line A is reached and once above this line the clear homogeneous solution no longer exists. In its place are two liquid phases. Thus, for example, at point 2 two liquid phases exist. One phase has a polymer concentration equal to the point where the horizontal line *a'-a* crosses line A and the other phase has a polymer concentration equal to the point where the horizontal line *b'-b* crosses line A. The former is often called the solvent-rich phase and the latter is the polymer-rich phase. As such the two phases are in general in equilibrium with each other.

Also shown is dashed line C which partially parallels the right hand side of line A. In the region between dashed line C and solid line A the solution is cloudy. The latter appears to be a result of the fact that the polymer contains molecules of different molecular weight and this cloudy layer represents the higher molecular weight portion going through the phase transition. Also shown is a dashed line B which sort of parallels the left hand side of line A. The significance of the area between line B and A is discussed hereinafter.

Now, in general, the resulting product, i.e., as to its physical shape, formed by discharging a particular concentration of thermoplastic polymer in a solvent, depends on the temperature of the two components. Consider a feed having the temperature 3 and the corresponding concentration of polymer. If this feed is discharged as disclosed in the aforementioned batch or continuous method the resulting product is plexifilament. The latter is a long, continuous string of thermoplastic polymer. Note that point 3 lies within the clear, homogeneous solution of the phase diagram of FIG. II.

On the other hand, if the feed is at the conditions represented by point 1, which is located between lines B and A, and is discharged in the aforementioned batch or continuous methods, the resulting product is shot. The latter is "BB" size particules of polymer essentially spherical in shape. It is believed that this is the result of a small amount of the polymer-rich phase that is available.

However, if the feed is at the conditions represented by point 2 and is discharged in the aforementioned batch or continuous method the resulting product is the desired fibrilla or fibril.

Another product can be formed during the methods heretofore disclosed. The product is best described as like "popcorn". The latter is relatively large chunks of non-filamentous foamed polymer. It seems to form at the start of a run or at the very end of a run or whenever the velocity is too low. It is not a desired product. However, it could be minimized, if not eliminated, by more rigid control of operating conditions during start up and shut down.

Also shown in FIG. II is a lower critical solution temperature. Below this temperature two liquid phases cannot exist whereas above this temperature two liquid phases can exist depending upon the polymer concentration.

The fibrilla produced can have a range of length between from about 0.05 to about 20 millimeters (mm) and a range of diameter between from about 1 to about 40 microns. A preferred length range would be between from about 0.1 to about 10 mm; a more preferred length range from about 0.2 to about 5 mm, with a still more preferred length range from about 0.5 to about 3.0 mm. As to fibril their lengths are about the same as the fibrilla.

The aforementioned fibrilla are packets of fibrils in a network structure which can be fed to a second step wherein the fibrilla are partially defibered in a mechanically or pneumatically produced force field either in the presence or absence of a second liquid phase such as water. Generally the fibrilla or fibrils will be treated with a wetting agent that causes the fibrilla or fibrils to be hydrophilic prior to mixing with cellulosic pulp. Examples of such agents are starch and guar gum.

The thermoplastic polymer used is normally a solid at room temperature. Generally the polymer is soluble in the solvent used at a temperature about above the polymer's melting point. However, the polymer is essentially insoluble in the same solvent at a temperature below about the polymer's freezing point. Also the polymer is one which will form with the solvent a two phase mixture at a temperature above the polymer's melting point. The two phase mixture consists of one phase which is a polymer-rich phase and the other phase which is a solvent-rich phase. Examples of suitable polymers include low density polyethylene, medium density polyethylene, high density polyethylene, isotactic or syndiotactic polypropylene, isotactic polystyrene, poly-4-methyl-pentane-1 and polybutene-1. Also a mixture of two or more of the foregoing polymers is useable. Other useable polymers include crystalline polyamides and polyesters.

The solvent used is normally a liquid at room temperature. Generally the solvent dissolves the polymer used at a temperature about above the polymer's melting point. However, the solvent essentially does not dissolve the polymer at a temperature below about the polymer's freezing point. Also the solvent is one which will form with the polymer a two phase mixture at a temperature above the polymer's melting point. The two phase mixture consists of one phase which is a solvent-rich phase and the other phase which is a polymer-rich phase. Also the solvent is one which will not chemically react with the polymer.

Examples of useable solvents include hydrocarbons such as hexane and/or pentane; a mixture of hexane and cyclohexane; halogenated hydrocarbons, e.g., chlorinated hydrocarbons, such as dichloromethane and/or methyl chloride and chlorinated and fluoridated hydrocarbons such as trichlorotrifluoroethane and/or trichlorofluoromethane. Other solvents are useable, for example, water can be a suitable solvent for nylon-4.

It is advantageous that solvent also be one which evaporates rapidly from the solid fibrilla or fibril. This makes for ease of recovery of the solvent for possible reuse in the process and helps avoid pollution. Also the solvent should be one which facilitates the cooling of the fibrilla or fibril from above its melting point to below its freezing point upon discharge. Such a property also facilitates the process by permitting the rapid formation of the fibrilla or fibril thereby increasing the hourly output of useable product.

The desired length of the fibrilla or fibril depends in part on the cellulosic pulp it is mixed with. Length of the fibers of the pulp depend somewhat on the source of the pulp fibers, for example, pulp fibers from a hardwood are different than those from a soft wood. Also the desired fibrilla or fibril length depends on the ultimate use of the resulting mixture of thermoplastic polymer fibrilla or fibril and cellulosic pulp. Thus for example, the desired length of the polymer product for a mixture used for teabags can be different than that used for wallpaper.

While the foregoing discussion is directed to the length of the polymer product it is necessary to consider the length of the product in terms of mean length. As explained in detail in the Examples the mean refers to the median of a normal distribution curve. Mean fibril length can also be expressed as $\mu$.

The desired mean fibril length range is from between about 0.8 mm. to about 2.9 mm. with the preferred range between from about 0.9 mm. to about 2.6 mm. with a more preferred range between from about 1.0 mm. to about 2.5 mm. As to the mean length of the fibrilla it is about the same as the fibril.

Thus, the process of preparing the solid thermoplastic polymer fibrilla or fibril comprises the following. A two phase mixture of the thermoplastic polymer or a blend of two or more such polymers and a suitable solvent is discharged through discharge means. Examples of the latter include nozzle and orifice. The mixture, prior to discharge, is in a zone having an elevated temperature and pressure. It is then discharged to a zone of lower temperature and pressure. The elevated temperature is limited by the decomposition temperature of the polymer and/or solvent used. In addition, because of energy costs, it can be more economical to use as low an elevated temperature consistent with other requirements such as the rapid vaporization of the solvent once the mixture is discharged. Also, the amount of vaporization must be such so as to cool the polymer to a temperature below the freezing point of the polymer. On the other hand, the elevated temperature used should be such as to cause the formation of the two-phase mixture heretofore described and must maintain the two-phase mixture just prior to discharging. The elevated pressure of the aforementioned elevated temperature zone is such as to provide the driving force to transport the mixture from one piece of equipment to another and through the discharge means. The upper limit of elevated pressure is determined by the strength of the materials used to construct the equipment used. But process economics generally suggest using as low a pressure consistent with the object of transporting the mixture through the system. Furthermore, some trade off is possible between temperature and pressure. As mentioned heretofore, the mixture is discharged through discharge means to a zone of lower temperature and pressure. Generally this lower zone is at ambient temperature and atmospheric pressure. Yet, it is operable to maintain the lower zone at a temperature and a pressure other than ambient conditions. Thus, the temperature could be higher or lower than ambient and the pressure could be higher than atmospheric or even lower than atmospheric. Thus the difference between the temperature and pressure of the two zones is also important. And this difference should be effective to cause rapid evaporation of the solvent after the discharging.

As stated heretofore one phase of the mixture discharged through the discharging means is a polymer-rich phase and the other phase is a solvent-rich phase. Furthermore, the concentration of the polymer or solvent in the two phases is such that they are considered to be in equilibrium with each other. The general basis for the equilibrium and two phases is described in further detail with the discussion for FIG. II and in particular for a n-hexane-high density polyethylene system in FIG. III. Also as mentioned heretofore, the polymer is soluble in the solvent at a temperature above the polymer's melting point but is essentially insoluble in the solvent at a temperature below about the freezing point of the polymer.

As indicated, the mixture is discharged through a discharge means. During the mixture's flow through the means it is in laminar flow. Laminar flow is different from turbulent flow. In turbulent flow, fluid elements are in chaotic motion, and small random fluctuations in the velocity at a point will exist even though the average means velocity may remain constant along its axis. Laminar flow is often described as a flow with constant separation of streamlines so that constant velocity surfaces remain at constant separation and lamina or sheets of fluid slide over one another.

As a result of the foregoing a solid thermoplastic polymer product is formed which is essentially free of the solvent and has a mean length which makes it useful for mixing with cellulosic pulp. The mixture of the pulp and polymer product then can be processed with conventional paper making equipment to prepare such diverse articles as teabags or wallpaper.

Another way of defining the liquid flow through the discharge means as by its Reynolds Number (hereinafter designated Re). According to Chemical Engineers Handbook, John H. Perry, 3rd Edition, for a circular tube with a Re greater than $2 \times 10^3$ the flow is usually turbulent and with a Re less than $2 \times 10^3$ the flow is streamline flow. The latter phrase is used herein as equal to laminar flow.

Another variable which can influence the mean product length is the length to internal diameter (L/D) ratio of the discharge means. While this ratio can vary substantially, engineering standards and commercial availability of standard pieces of equipment and economics all influence the range of ratios. One extreme is that the internal diameter of the discharge means is so small that a further reduction in size of the diameter yields a continuous monofilament. However, generally the range of the ratio is between from about 0.5 to 100 with 1 to 32 preferred. Such ratios are effective in obtaining the desired fibril length.

Thus a desired mean fibril length can be obtained by causing the flowing mixture to have suitable Reynolds Number and causing the discharge means to have a suitable L/D ratio. With both an effective Reynolds Number and an effective L/D ratio fibrils can be produced which have a mean length making them useful for mixing with cellulosic pulp.

For applicant's experimental results a statistical relationship between fibrils having a desired mean length and Reynolds Number and L/D ratio can be developed. The following equation (I) expresses that statistical relationship:

$$\text{mean fibril length} = 0{,}9122(L/D)^{-0.0498} + 489.5(Re)^{-1}(L/D)^{-0.2619} \quad \text{(I)}$$

And as indicated heretofore the desired mean fibril length is between from about 0.8 to about 2.9 mm.

The aforementioned equation can be represented in graphical form. FIG. IV is such a graph. The graph illustrates how the mean fibril length decreases substantially as the Re number increases to about 1000. The graph also illustrates how the mean fibril length decreases less appreciably as the Re number increases from about 1000 to about 4000. In the latter range changes in L/D ratio can more effectively change the mean fibril length. A transition to turbulent flow for Re number above about 2100 may also change the mean fibril length.

The fibrilla or fibril produced by this process have lengths which are approximately normally distributed about the mean. The standard deviation ($\Sigma$) of a normal distribution is a measure of the breadth of the distribution. A small standard deviation ($\Sigma$) means that most product lengths are close to the mean ($\mu$) whereas a large value of $\Sigma$ means that product lengths are distributed quite broadly around the mean ($\mu$). About 68% of the product lengths are included in the size range from $\Omega$-$\Sigma$ to $\Omega+\Sigma$.

As stated heretofore, this process can be used to produce a polymer product having a mean length and a size distribution that makes the fibrilla and/or fibril useful for mixing with cellulosic pulp. Both the mean length ($\mu$) and the standard deviation ($\Sigma$) of the size distribution can be dependent on the Reynolds Number (Re) of the flowing mixture and the ratio of length to internal diameter (L/D) of the discharge means. Thus, in addition to the previously disclosed equation I, the following equation (II) expresses the relationship between the standard deviation ($\Sigma$) and the mean fibril length ($\Omega$):

$$(\Sigma)^{0.740}=\mu/[2.361-0.00060(Re)-0.0163(L/D)] \quad (II)$$

and the resulting standard deviation of the fibril length distribution is between from about 0.4 millimeters to about 1.5 millimeters. The values of $\Omega$ and $\Sigma$ are strongly linked as seen in equation II. However, they can also be varied independently of one another.

By suitably adjusting Re and L/D to maintain constant $\omega$ (equation I) product length distributions with various values of $\Sigma$ can be produced according to equation II.

Generally, this process can produce normally distributed product lengths with the mean in the most desirable range from about 0.8 mm to about 2.9 mm, and with the standard deviation varying between about 0.4 mm to about 1.5 mm.

In order to further illustrate the invention the following examples are given.

EXAMPLES

Single-Polymer Product

Solid thermoplastic fibrilla of a single polymer was prepared in the following manner. A two-liter Parr reactor was used. It contained an inlet for pressuring with nitrogen; a sealed stirrer and an 0.25 inch outside diameter 316 stainless steel dip tube which extended almost to the bottom of the reactor. A 0.25 inch outside diameter line about 18 inches long connected the dip tube with a stainless steel block. The latter was drilled to accepted the connecting line, a miniature transducer, a thermocouple and a nozzle. Heating elements were attached to the reactor, connecting line, block and nozzle so that all the pieces could be heated to an elevated temperature. Prior to its use the reactor was opened and 134 grams of high density polyethylene, and 250 milliliters of dichloromethane and 750 milliliters of Freon® 113 were added to the reactor. The amount of polymer present was 16.9 weight %. The reactor was then closed and purged with nitrogen and then pressured to 300 psig with nitrogen. The reactor and other pieces were then heated to 180° C. Thus, according to Figure III the mixture was in the two liquid phase zone. After reaching 180° C the nitrogen pressure was increased to about 600 psig. The nozzle was one inch long, had an ⅛ inch internal diameter, had an exit angle of 120° C and length over diameter ratio (L/D) of 8. After the pressure was increased, a valve, which was between the reactor and the steel block, was fully opened rapidly and the contents of the reactor discharged into a collecting pail. The resulting fibrilla was removed to a hood and spread out to allow any remaining solvent to evaporate.

After the solvent evaporated 4 grams of the foregoing fibrilla was placed in a Waring blendor with 500 milliliters of water and a wetting agent. The wetting agent causes the fibrilla to become hydrophilic. The Waring blendor was run for 10 minutes at high speed and then passed through a Clark Classifier. The latter is described hereinafter. The results, run A, from the Classifier are shown in the following Table 1. Also shown in Table 1, for comparative purposes, run B, is another sample which was run in the Waring blendor in the following manner. Again, 4 grams of fibrilla, 500 milliliters of water and a wetting agent were used but this time the Waring blendor was run for only 0.5 minutes at low speed and with the blade reversed.

TABLE 1

| Weight % Retained on Mesh | Run A | Run B |
|---|---|---|
| 20 | 13.4 | 49.4 |
| 35 | 24.0 | 14.8 |
| 65 | 23.9 | 9.5 |
| 150 | 18.0 | 8.6 |
| through 150 | 20.6 | 17.7 |

Thus the data of Table 1 shows that the beating in a Waring blendor increases the amount of material that will pass through the smaller screens. In all the runs reported hereinafter the fibril length is after the fibrilla, along with the wetting agent, has been beaten in a Waring blendor at high speed for 10 minutes.

The mean fibril length (mfl) in millimeters (mm) of the resulting fibril was determined in the following manner. The fibril was classified using a Clark Classifier according to the procedure given in TAPPI method - "Fiber Length of Pulp by Classification" - T233 su-64. Typical results from one run (#1) are as follows:

Table 2

| Weight % Retained on Mesh | | | | |
|---|---|---|---|---|
| 20 | 35 | 65 | 150 | Through 150 |
| 56.0 | 17.7 | 14.6 | 6.8 | 4.9 |

Microscopic examination of the foregoing material indicated, except for the material retained on the 20 mesh screen, that the fibril lengths of the fractions retained by each screen was relatively constant and that distribution of fibril lengths was normal. This finding is supported by J. E. Tasman in his reported results in TAPPI, Volume 55, No. 1, January 1972, page 136–138 for a Bauer-McNett classification. The title of the article is "The Fiber Length of Bauer-McNett Screen Fractions". He also reported that the distribution of his material is reasonably normal (Gaussian). In addition, he found that the average lengths of the material retained on the screens are as follows:

Table 3

| Mesh Size | Average material length (mm) retained on mesh |
|---|---|
| 20 | 2.6 |
| 35 | 1.6 |
| 65 | 0.9 |
| 150 | 0.6 |

The mean fibril length, using the foregoing information, was calculated by standard statitstical techniques. Thus, based on a normal distribution:

$$t = \frac{x - \mu}{6} \quad (1)$$

where $t$ = unit normal deviate
$x$ = random variable
$\mu$ = mean
$\Sigma$ = standard deviation
The fraction $>t$ is identified as $$1 - \Psi(t) \equiv 1 - \left(\frac{1}{\sqrt{2\pi}}\right) \int_{-\infty}^{t} l^{\frac{-\tau^2}{2}} d\tau$$

Equivalently, in terms of $\alpha$, the fraction between $-t$ and $+t$, the fraction $>t$ is $$1 - \Psi \equiv 0.5 - \frac{\alpha}{2} \tag{2}$$

Each data point consists of a value of x (fibril length retained) and a corresponding value of weight fraction retained above the size. Choosing two data points from the aforementioned tables 2, and 3,

| | | |
|---|---|---|
| data point 1 : | | |
| | $x_1 = 1.6$ | |
| | $0.5 - \left(\frac{\alpha}{2}\right)_1 = .737$ | (fraction retained on 20 and 35 mesh screens) |
| data point 2 : | | |
| | $x_2 = 0.9$ | |
| | $0.5 - \left(\frac{\alpha}{2}\right)_2 = .883$ | (fraction retained on 20, 35 and 65 mesh screens) |

it is found that $$\left(\frac{\alpha}{2}\right)_1 = -0.237 \tag{3}$$

$$\left(\frac{\alpha}{2}\right)_2 = -0.383$$

Using these values of $(\alpha/2)_1$ and $(\alpha/2)_2$, and a suitable table such as that which appears in Handbook of Probability and Statistics with Tables, Burkington and May, 1970, McGraw-Hill, Table IX, page 367, the following values of $t$ are found:

$$t_1 = -0.635$$

$$t_2 = -1.19$$

and, $$t_1/t_2 = 0.534$$

Now, from equation (1) written for each data point, it is possible to solve for $\mu$ in terms of $t_1/t_2$, $X_1$ and $X_2$:

$$\mu = \frac{(t_1/t_2)x_2 - x_1}{(t_1/t_2) - 1} \tag{4}$$

The appropriate values were substituted in equation 4, thus:

$$\mu = \frac{(0.534)\,(0.9) - 1.6}{0.534 - 1}$$

(mean fibrilla length)

$\mu = 2.39$ mm.

$\sigma = (x_1 - \mu)/t_1 = (1.6 - 2.39)/(-0.635) = 1.24$ mm.

(standard deviation)

The Reynolds Number (Re) for each of the runs was determined in the following manner:

$$Re = \frac{DV\rho}{\bar{\mu}} = \frac{DV}{\nu} \tag{5}$$

when

D = nozzle internal diameter

V = fluid velocity $\rho$ = density $\bar{\mu}$ = viscosity $\nu$ = kinematic viscosity = $\bar{\mu}/\rho$ The fluid velocity ($\nu$) was determined in the following manner:

$$V = \frac{Q}{At} \tag{6}$$

where $\phi$ = volume of flow t = time of flow

A = cross sectional area of nozzle

Developing Re for each of the runs involved the use of certain data. Using one run as an example, the run data was used in the following manner. First the following Tables 4 and 5 were developed for a run using 97.5 grams of high density polyethylene, 570 milliliters of Freon® 113 and 250 milliliters of dichloromethane.

Table 4

SOLVENT DATA

| | Charge wt. (gms) | Solvent Volume (mls) at 20° C | 150° C | 180° C |
|---|---|---|---|---|
| Freon® 113 | 1173.75 | 750 | 961 | 1044 |
| Dichloromethane | 331.5 | 250 | 320 | 348 |
| Totals | 1505.25 | 1000 | 1281 | 1392 |

Table 5

CHARGE DATA

Solvent = mixture of Freon® 113 and dichloromethane

Polymer = High Density Polyethylene, density at 150° and 180° C assumed to be 0.8

| Polymer Weight (gms) | Total Wt. of Polymer and Solvent (gms) | Volume (mls) of Charge at 150° C | 180° C | Density of Charge (lbs/ft³) at 150° C | 180° C |
|---|---|---|---|---|---|
| 22.9 | 1528 | 1308 | 1421 | 72.907 | 67.09 |
| 45.6 | 1551 | 1335 | 1449 | 72.50 | 66.79 |
| 97.5 | 1603 | 1395 | 1514 | 71.72 | 66.06 |
| 164.0 | 1669 | 1474 | 1579 | 70.69 | 65.21 |
| 234.9 | 1740 | 1557 | 1686 | 69.76 | 64.40 |
| 308 | 1813 | — | 1777 | — | 63.66 |

The run was at 180° C. Thus using the appropriate data in equation 6 the following results:

$$V = \frac{Q}{At} = \frac{4Q}{\pi D^2 t}$$

$$= \frac{4(1.514 \text{ LITERS})(0.03531 \text{ Ft}^3/\text{LITER})}{(0.125 \text{ INCH})^2 \left(\frac{\text{Ft}}{12 \text{ INCH}}\right)^2 (7.5 \text{ SEC.})}$$

$V = 84$ Ft/SEC

Viscosity was determined by use of the modified HagenPoiseuille equation. Required for the equation is a fully developed velocity distribution at both upstream and downstream stations; McCable & Smith, Unit Operations of Chemical Engineering, McGraw Hill Book Co., 1956; page 51. The equation used is:

$$8L\nu = \frac{(P_a - P_b)g_c \pi D^4 \theta}{16\rho Q} - \frac{Q}{\pi\theta}$$

where:

L = length of nozzle, ft.

$\nu$ = kinematic viscosity, ft.$^2$/sec.

$p_a$ = pressure at nozzle entrance, lb-force/ft$^2$ $p_b$ = pressure at nozzle exit, lb-force/ft$^2$ $g_c$ = 32.174 ft-lb/lb force-sec.$^2$ $D$ = diameter of nozzle, ft.

$\theta$ = flow time $\rho$ = density of solvent-polymer mixture, lb/ft$^3$

Q = volume of flow

Discharge means entrance and exit corrections were unnecessary, because only experiments utilizing the nozzle with the largest value of L/D (32) were used to determine viscosity.

Thus for the aforementioned run:

8 (4 in)(1 ft/12 in)$\nu$ = {(380 lb/in$^2$)(144 ft$^2$/in$^2$)(32.174 ft-lb force-sec$^2$)(3.14)[(0.125 in)(1 ft/12 in)]$^4$(7.5 sec)}÷ {16 (66.06 lb/ft$^3$)(1.514 liters)(0.0353 ft$^3$/liter)}-(1.514 liters)(0.0353 ft$^3$/liter) ÷ (3.14)(7.5 sec) = 0.00239 ft$^2$/sec Calculation of the viscosity of the polymer-solvent mixture from eight experiments which used a nozzle with L/D = 32 gave the following results:

| Run No. | Viscosity Calculated (ft$^2$/sec) |
|---|---|
| 12 | 0.00253 |
| 13 | 0.00238 |
| 14 | 0.00061 |
| 15 | 0.00211 |
| 16 | 0.00174 |
| 17 | 0.00239 |
| 18 | 0.00220 |
| 19 | 0.00247 |

Average of seven best results; (dropping the low 0.00061 which appears to be in error kinematic viscosity = 0.00236 ft$^2$/sec, = 219 centistokes; viscosity = 232 centipoise The foregoing fluid mixture, as evidenced by runs 12-19, has a constant viscosity in the range of interest. While the mixture is probably non-Newtonian at low shear rates, it has a constant high shear viscosity in all our runs. This constant viscosity provides the basis for the use of the Hagen-Poiseuille equation which strictly applies only for Newtonian or constant viscosity fluids.

Thus the foregoing value was the viscosity of 97.5 gms of high density polyethylene in a solvent composed of 750 mls of Freon ® 113 and 250 mls of dichloromethane. For each experiment that utilized this combination and quantity of polymer and solvent, the Re was calculated using the kinematic viscosity 0.00235 ft$^2$/sec. From equation (5):

$$Re = \frac{D\bar{V}}{\nu}$$

-continued $$Re = \frac{(0.125 \text{ inch})\ (1 \text{ ft}/12 \text{ inch})\ (84 \text{ ft/sec})}{(0.00236 \text{ ft}^2/\text{sec})}$$

$$Re = 368$$

The foregoing calculations were made for the runs shown in the accompanying Table 6. Then a non-linear regression of the data reported in Table 6 yielded the aforementioned equation I. Using equation I, Figure V was developed. Other polymers, e.g., isotactic polystyrene, poly-4-methyl-pentane-1 and polybutene-1 can be used and similar fibril will be obtained.

The percent of the total variation in the mean fibril length that is attributable to the aforementioned non-linear regression is 77.1% for 44 of the 56 experiments reported in Table 6 (This includes all runs in Table 6 except runs 3, 4, 39-42, 45-50. Runs 3 and 4 were inadvertently omitted from regression. Runs 39-42 used different amounts of polymer and runs 45-50 used hexane as solvent as well as different amounts of polymer). The standard error of the estimate is 0.30 millimeters. Thus about 68% of the experiments give a mean fibril length within 0.30 millimeters of the regression equation prediction..

Multicomponent Polymer Product

As indicated a blend of two or more polymers can be used as a feed to disclosed method. For example, a mixture of 50 weight percent high density polyethylene and 50 weight percent isotactic polypropylene was used in lieu of the previously used high density polyethylene. Satisfactory fibrilla and fibril were prepared. The accompanying Table 7 reports the conditions used and the resulting data.

A mixture of medium density polyethylene and isotactic polypropylene gave similar results. Also a multicomponent product of 50 weight percent polystyrene and 50 weight percent of polyethylene had an opacity which appeared to be better than the product of either component alone.

As indicated in Table 7, a weighted average fibril length was calculated. This calculation was based on the following equation:

$$\text{weight average fibrilla length (WAFL)} = \frac{w_1 l_1 + {}_2 l_2 \cdot \cdots \cdot w_n l_n}{W}$$

wherein $w$ = dry weight of fibril retained on each screen, grams l = average fibril length of each fraction, millimeters W = total weight The average fibril length for each fraction retained is based on J. E. Tasman's data.

Mixture of other polymers, e.g., isotactic polystyrene and poly-4-methylpentane-1, poly-4-methylpentene-1 and polybutene-1, can be used to prepare multicomponent polymer product.

TABLE 6

PROCESSING AND PRODUCT DATA

| | Nozzle Data | | | Processing Conditions(1) | | | | | | Product Data(3) Clark Classification Wt% Retained on Mesh | | | | | |
|---|---|---|---|---|---|---|---|---|---|---|---|---|---|---|---|
| Run No. | Length (in.) | Diam. (in.) | L/D | Density (lbs/ft$^3$) | Volume (Liters) | Temp. | Press. (psig) | Time (sec.) | Re No. | 20 | 35 | 65 | 150 | through 150 | Mean Length (mm) |
| 1 | 0.5 | 0.0625 | 8 | 71.72 | 1.395 | 150 | 480 | 15 | 268 | 56.0 | 17.7 | 14.6 | 6.8 | 4.9 | 2.39 |
| 2 | 0.5 | 0.0625 | 8 | 71.72 | 1.395 | 150 | 500 | 15 | 268 | 61.0 | 16.0 | 12.8 | 6.1 | 4.0 | 2.58 |

TABLE 6-continued

PROCESSING AND PRODUCT DATA

| Run No. | Nozzle Data Length (in.) | Diam. (in.) | L/D | Processing Conditions[1] Density (lbs/ft³) | Volume (Liters) | Temp. | Press. (psig) | Time (sec.) | Re No. | Product Data[3] Clark Classification Wt% Retained on Mesh 20 | 35 | 65 | 150 | through 150 | Mean Length (mm) |
|---|---|---|---|---|---|---|---|---|---|---|---|---|---|---|---|
| 3 | 2 | 0.0625 | 32 | 71.72 | 1.395 | 150 | 600 | 18 | 223 | 47.3 | 18.9 | 17.3 | 9.7 | 6.7 | 2.13 |
| 4 | 2 | 0.0625 | 32 | 71.72 | 1.395 | 150 | 600 | 16.5 | 243 | 28.5 | 25.2 | 20.2 | 14.9 | 11.2 | 1.72 |
| 5 | 1 | 0.0625 | 8 | 71.72 | 1.395 | 150 | 200 | 3 | 670 | 2.0 | 22.3 | 44.0 | 21.3 | 10.3 | 1.18 |
| 6 | 1 | 0.0625 | 8 | 71.72 | 1.395 | 150 | 170 | 3 | 669 | 1.2 | 13.2 | 51.2 | 26.1 | 8.3 | 1.09 |
| 7 | 1 | 0.0625 | 8 | 71.72 | 1.395 | 150 | 120 | 4.5 | 446 | 1.5 | 29.2 | 43.0 | 18.9 | 7.4 | 1.29 |
| 8 | 1 | 0.0625 | 8 | 71.72 | 1.395 | 155 | 440 | 4 | 502 | 2.3 | 30.6 | 38.1 | 20.7 | 8.2 | 1.28 |
| 9 | 0.5 | 0.0625 | 8 | 66.06 | 1.514 | 180 | 880 | 20 | 276 | 36.8 | 25.3 | 17.7 | 10.8 | 9.4 | 2.01 |
| 10 | 0.5 | 0.0625 | 8 | 66.06 | 1.514 | 183 | 620 | 24 | 230 | 34.4 | 29.8 | 17.6 | 10.6 | 7.7 | 2.07 |
| 11 | 0.5 | 0.0625 | 8 | 66.06 | 1.514 | 177 | 1310 | 15 | 368 | 34.9 | 23.7 | 16.2 | 10.6 | 14.6 | 1.94 |
| 12 | 2 | 0.0625 | 32 | 66.06 | 1.514 | 186 | 340 | 57 | 97 | 60.1 | 17.7 | 11.4 | 4.9 | 5.8 | 2.75 |
| 13 | 2 | 0.0625 | 32 | 66.06 | 1.514 | 189 | 590 | 33 | 168 | 33.6 | 25.5 | 20.6 | 11.4 | 8.9 | 1.87 |
| 14 | 2 | 0.0625 | 32 | 66.06 | 1.514 | 186 | 1330 | 10 | 553 | 8.3 | 25.3 | 26.8 | 19.7 | 19.9 | 1.17 |
| 15 | 2 | 0.0625 | 32 | 66.06 | 1.514 | 186 | 860 | 22 | 251 | 13.8 | 29.8 | 25.3 | 16.9 | 14.2 | 1.43 |
| 16 | 4 | 0.125 | 32 | 66.06 | 1.514 | 180 | 530 | 5 | 553 | 0.8 | 6.6 | 45.0 | 31.4 | 16.1 | 0.93 |
| 17 | 4 | 0.125 | 32 | 66.06 | 1.514 | 179 | 380 | 7.5 | 369 | 0.4 | 10.9 | 55.2 | 24.9 | 8.6 | 1.08 |
| 18 | 4 | 0.125 | 32 | 66.06 | 1.514 | 180 | 200 | 12 | 230 | 3.4 | 39.1 | 37.0 | 11.7 | 8.7 | 1.47 |
| 19 | 4 | 0.125 | 32 | 66.06 | 1.514 | 176 | 200 | 13 | 213 | 2.9 | 37.5 | 37.0 | 15.2 | 7.3 | 1.43 |
| 20 | 0.16 | 0.052 | 3 | 66.06 | 1.514 | 180 | 840 | 25 | 265 | 66.6 | 13.6 | 10.4 | 5.3 | 4.1 | 2.87 |
| 21 | 0.16 | 0.052 | 3 | 66.06 | 1.514 | 180 | 1270 | 12 | 553 | 57.0 | 8.2 | 14.0 | 7.0 | 3.8 | 2.25 |
| 22 | 0.16 | 0.125 | 1.2 | 66.06 | 1.514 | 180 | 300 | 3.6 | 768 | 2.9 | 46.5 | 29.9 | 15.0 | 5.7 | 1.59 |
| 23 | 0.16 | 0.125 | 1.2 | 66.06 | 1.514 | 193 | 260 | 6 | 461 | 11.1 | 46.8 | 26.6 | 11.4 | 4.0 | 1.77 |
| 24 | 0.16 | 0.125 | 1.2 | 66.06 | 1.514 | 190 | 160 | 9 | 307 | 16.9 | 40.2 | 29.4 | 10.0 | 3.6 | 1.74 |
| 25 | 0.08 | 0.025 | 3.1 | 66.06 | 1.514 | 180 | 920 | 102 | 136 | 75.7 | 8.9 | 7.6 | 4.3 | 3.6 | 3.38 |
| 26 | 0.08 | 0.031 | 2.5 | 66.06 | 1.514 | 180 | 870 | 56 | 199 | 73.9 | 9.9 | 8.5 | 4.5 | 3.3 | 3.17 |
| 27 | 0.08 | 0.0635 | 1.2 | 66.06 | 1.514 | 180 | 800 | 17 | 320 | 63.5 | 13.9 | 12.8 | 6.0 | 3.8 | 2.57 |
| 28 | 0.08 | 0.076 | 1.0 | 66.06 | 1.514 | 180 | 680 | 11 | 413 | 52.3 | 20.0 | 17.2 | 7.1 | 3.1 | 2.23 |
| 29 | 0.08 | 0.076 | 1.0 | 66.06 | 1.514 | 180 | 530 | 15 | 303 | 58.9 | 16.5 | 13.8 | 6.4 | 4.5 | 2.48 |
| 30 | 0.08 | 0.089 | 0.9 | 66.06 | 1.514 | 180 | 650 | 9 | 431 | 45.7 | 25.4 | 18.0 | 6.4 | 4.4 | 2.18 |
| 31 | 0.08 | 0.089 | 0.9 | 66.06 | 1.514 | 180 | 1000 | 6 | 647 | 26.9 | 34.3 | 25.5 | 8.7 | 4.7 | 1.83 |
| 32 | 0.08 | 0.089 | 0.9 | 66.06 | 1.514 | 180 | 460 | 11 | 353 | 52.6 | 21.6 | 16.0 | 6.1 | 3.7 | 2.35 |
| 33 | 0.08 | 0.0995 | 0.8 | 66.06 | 1.514 | 180 | 880 | 4.5 | 772 | 9.9 | 41.9 | 31.5 | 12.3 | 4.5 | 1.63 |
| 34 | 0.08 | 0.0995 | 0.8 | 66.06 | 1.514 | 180 | 610 | 6 | 579 | 29.8 | 33.9 | 23.8 | 8.8 | 3.7 | 1.91 |
| 35 | 0.08 | 0.0995 | 0.8 | 66.06 | 1.514 | 180 | 440 | 8 | 434 | 34.9 | 30.6 | 22.4 | 8.5 | 3.5 | 1.96 |
| 36 | 0.16 | 0.125 | 1.2 | 66.06 | 1.514 | 180 | 660 | 3 | 921 | 1.2 | 21.3 | 48.0 | 21.2 | 8.3 | 1.19 |
| 37 | 0.16 | 0.125 | 1.2 | 66.06 | 1.514 | 180 | 440 | 4 | 691 | 3.1 | 40.0 | 35.5 | 16.1 | 5.2 | 1.48 |
| 38 | 0.16 | 0.125 | 1.2 | 66.06 | 1.514 | 180 | 300 | 6 | 461 | 7.0 | 43.8 | 31.7 | 13.0 | 4.5 | 1.61 |
| 39 | 0.16 | 0.125 | 1.2 | 66.79 | 1.449 | 180 | 510 | 5 | 782 | 0.6 | 3.7 | 32.9 | 39.4 | 23.3 | 0.73 |
| 40 | 0.16 | 0.125 | 1.2 | 65.21 | 1.579 | 180 | 440 | 4.5 | 494 | 36.9 | 33.3 | 20.2 | 7.4 | 2.1 | 2.07 |
| 41 | 0.16 | 0.125 | 1.2 | 64.40 | 1.686 | 180 | 430 | 6 | 296 | 62.7 | 18.5 | 11.6 | 5.2 | 2.2 | 2.70 |
| 42 | 0.16 | 0.125 | 1.2 | 63.66 | 1.777 | 180 | 380 | 7 | 224 | 52.0 | 27.4 | 13.9 | 4.8 | 1.8 | 2.44 |
| 43 | 0.16 | 0.125 | 1.2 | 66.06 | 1.514 | 180 | 380 | 3 | 921 | 5.6 | 40.6 | 34.1 | 14.6 | 5.1 | 1.53 |
| 44 | 0.08 | 0.125 | 0.6 | 66.06 | 1.514 | 180 | 520 | 4.5 | 614 | 2.8 | 35.3 | 37.8 | 17.6 | 6.5 | 1.39 |
| 45 | 1.0 | 0.125 | 8 | 30.82 | 1.471 | 180 | 490 | 25 | 1072 | 2.5 | 38.9 | 36.7 | 16.1 | 5.8 | 1.44 |
| 46 | 1.0 | 0.125 | 8 | 31.45 | 1.520 | 180 | 460 | 3.0 | 477 | 6.7 | 50.1 | 30.4 | 10.3 | 2.5 | 1.72 |
| 47 | 1.0 | 0.125 | 8 | 31.89 | 1.555 | 180 | 360 | 4.0 | 252 | 8.5 | 50.2 | 29.3 | 9.7 | 2.3 | 1.76 |
| 48 | 1.0 | 0.125 | 8 | 31.89 | 1.555 | 180 | 410 | 3.5 | 338 | 17.9 | 45.2 | 26.5 | 8.8 | 1.6 | 1.85 |
| 49 | 1.0 | 0.125 | 8 | 31.89 | 1.555 | 180 | 390 | 4.0 | 216 | 8.4 | 51.1 | 29.0 | 9.1 | 2.3 | 1.76 |
| 50 | 1.0 | 0.125 | 8 | 32.32 | 1.593 | 180 | 350 | 4.5 | 192 | 20.2 | 43.6 | 26.2 | 8.6 | 2.1 | 1.86 |
| 51 | 1.0 | 0.125 | 8 | 71.72 | 1.395 | 160 | 200 | 9 | 223 | 34.3 | 30.7 | 22.4 | 8.7 | 3.9 | 1.96 |
| 52 | 1.0 | 0.125 | 8 | 66.06 | 1.514 | 166 | 240 | 10 | 276 | 15.6 | 37.5 | 29.8 | 11.6 | 5.5 | 1.66 |
| 53 | 1.0 | 0.125 | 8 | 66.06 | 1.514 | 166 | 570 | 4 | 690 | 0.9 | 15.7 | 45.6 | 25.8 | 12.1 | 1.06 |
| 54 | 0.5 | 0.0625 | 8 | 71.72 | 1.395 | 150 | 280 | 28 | 143 | 57.4 | 17.0 | 14.3 | 7.2 | 4.1 | 2.41 |
| 55 | 0.5 | 0.0625 | 8 | 66.06 | 1.514 | 166 | 300 | 40 | 138 | 59.9 | 16.7 | 12.0 | 5.8 | 5.7 | 2.66 |
| 56 | 0.5 | 0.0625 | 8 | 66.06 | 1.514 | 183 | 330 | 30 | 184 | 68.6 | 12.9 | 9.8 | 4.6 | 4.1 | 2.97 |

[1]Conditions are when material was discharged. For all runs except 39–42 and 45–50, the amount of polymer used was 97.5 gms.
[2]Runs 45–50 inclusive were performed with 1000 milliliters of hexane as the solvent, the others with 250 milliliters of dichloromethane and 750 milliliters of Freon ® 113.
[3]In these runs the polymer was high density polyethylene.

TABLE 7

SUMMARY OF MULTICOMPONENT POLYMER RUNS[5]

| Run | Charge: Solvent, mls Freon ® 113 | MDC[1] | Polymer, gms PP[2] | HDPE[3] | Clark Classification Data: Wt.% Retained on Mesh 20 | 35 | 65 | 150 | Through 150 | WAFL[4] |
|---|---|---|---|---|---|---|---|---|---|---|
| 1 | 750 | 250 | 83.5 | 83.5 | 64.3 | 18.7 | 11.3 | 3.9 | 1.8 | 2.10 |
| 2 | 750 | 250 | 50 | 50 | 56.6 | 25.3 | 12.6 | 4.0 | 1.5 | 2.02 |
| 3 | 800 | 200 | 50 | 50 | 36.0 | 37.8 | 17.8 | 6.0 | 2.5 | 1.75 |
| 4 | 900 | 100 | 50 | 50 | 18.5 | 46.6 | 23.9 | 8.0 | 3.0 | 1.50 |
| 5 | 800 | 200 | 50 | 50 | 33.5 | 39.1 | 17.7 | 5.9 | 3.7 | 1.71 |

[1]MDC = Dichloromethane
[2]PP = Polypropylene
[3]HDPE = High Density Polyethylene
[4]WAFL = weighted average fibrilla length
[5]Pressure 1000 psig, temperature 176° C, nozzle L/D = 16, ⅛ inch diameter, 2 inches length.

The invention claimed is:

1. A process for preparing solid thermoplastic polymer fibrilla or fibril comprising:

(a) discharging through a discharge means a two phase mixture of a thermoplastic polymer selected from the group consisting of low density polyethylene, medium density polyethylene, high density polyethylene, isotactic or syndiotactic polypropylene, isotactic polystyrene poly-4-methylpentene-1 and polybutene-1 or a blend of two or more such polymers and a solvent selected from the group consisting of pentane, hexane, cyclohexane, dichloromethane, methylchloride, trichlorotrifluoroethane, trichlorofluoromethane and mixtures thereof, where (1) the discharging is from a zone of both an elevated temperature and pressure range to a zone of lower temperature and pressure, (2) the elevated temperature range causes the formation of the two-phase mixture and maintains the two-phase mixture prior to discharge and after discharging permits vaporization of the solvent to cool the polymer to a temperature below the freezing point of the polymer, (3) the differences between both the elevated temperature and pressure range and both the lower temperature and pressure are effective to cause rapid evaporation of the solvent after the discharging, (4) one phase of the mixture is a polymer-rich phase and the other phase is a solvent-rich phase and concentrations between the two phases are in general equilibrium with each other, (5) the polymer is soluble in the solvent at a temperature above the polymer's melting point but is essentially insoluble in the solvent at a temperature below about the freezing point of the polymer;

(b) and the mixture flowing has a Reynolds, Re, of less than $2 \times 10^3$, and the means has a ratio of length of internal diameter, L/D, in the range between from about 0.5 to about 100 and that the relationship between the Re, L/D, polymer and solvent is such that according to the following equation:

$$\text{mean fibril length} = 0.9122\,(L/D)^{-0.0498} + 489.5(Re)^{-1}\,(L/D)^{-0.2619}$$

the resulting mean fibril length is between from about 0.8 millimeters to about 2.9 millimeters.

2. Process according to claim 1 wherein the standard deviation, $\upsilon$, is related to the mean fibril length, $\mu$ according to the following equation:

$$(\upsilon)^{0.740} = \mu/[2.361\text{-}0.00060(Re)\text{-}0.0163\ L/D\ ]$$

and the resulting standard deviation of the fibril length distribution is between from about 0.4 millimeters to about 1.5 millimeters.

3. Process according to claim 1 wherein essentially none of the following are formed: plexifilaments, spherical particles and relatively large masses of non-filamentous foamed material.

4. Process according to claim 1 wherein the discharging means is a nozzle or orifice.

5. Process according to claim 4 wherein the mean fibril length is between from about 1 millimeter to about 2.5 millimeters.

6. In the process for preparing solid thermoplastic polymer fibrilla or fibril wherein a two phase mixture of a thermoplastic polymer or a blend of two or more such polymers and a solvent is discharged through discharging means having a ratio of length to internal diameter ratio, L/D, between from about 0.5 to 100, and wherein the mixture is discharged from a zone of both an elevated temperature and pressure range to a zone of lower temperature and pressure, and the elevated temperature range causes the formation of the two-phase mixture and maintains the two-phase mixture prior to discharge and after discharging permits vaporization of the solvent to cool the polymer to a temperature below the freezing point of the polymer, and the differences between both the elevated temperature and pressure range and both the lower temperature and pressure are effective to cause rapid evaporation of the solvent after the discharging, and wherein one phase of the mixture is a polymer-rich phase and the other phase is a solvent-rich phase and concentrations between the two phases are in general equilibrium with each other and wherein the polymer is soluble in the solvent at a temperature above the polymer's melting point but is essentially insoluble in the solvent at a temperature below about the freezing point of the polymer and whereby the formed solid thermoplastic polymer fibrilla or fibril is essentially free of solvent and has a mean length which makes it useful for mixing with cellulosic pulp, the improvement comprises that the thermoplastic polymer is selected from the group consisting of low density polyethylene, medium density polyethylene, high density polyethylene, isotactic or syndiotactic polypropylene, isotacticpolystyrene, poly-4-methylpentene-1 and polybutene-1 or a mixture thereof and the solvent is selected from the group consisting of pentane, hexane, cyclohexane, dichloromethane, methylchloride, trichlorotrifluoroethane, trichlorofluoromethane and mixtures thereof and that the Reynolds Number, Re, of the flowing mixture is less than $2 \times 10^3$ and the ratio of length to internal diameter, L/D, of the discharge means are such that according to the following equation;

$$\text{mean fibril length} = 0.9122\,(L/D)^{-0.0498} + 489.5(Re)^{-1}\,(L/D) - 0.2619$$

the resulting mean fibril length is between from about 0.8 millimeters to about 2.9 millimeters.

* * * * *